US007293840B1

(12) United States Patent
Schu

(10) Patent No.: US 7,293,840 B1
(45) Date of Patent: Nov. 13, 2007

(54) SWIMMING POOL FURNITURE

(76) Inventor: Larry Schu, 6601 Darnbush, Evansville, Vanderburgh County, IN (US) 47712

( * ) Notice: Subject to any disclaimer, the term of this patent is extended or adjusted under 35 U.S.C. 154(b) by 0 days.

(21) Appl. No.: 11/598,453

(22) Filed: Nov. 13, 2006

(51) Int. Cl.
*A47C 1/12* (2006.01)
*B63C 9/08* (2006.01)

(52) U.S. Cl. ..... 297/451.13; 297/448.2; 441/130

(58) Field of Classification Search ..... 441/130; 4/496, 590, 578.1; 297/451.13, 452.65, 448.2, 297/440.24, 440.1, 463.2
See application file for complete search history.

(56) References Cited

U.S. PATENT DOCUMENTS 2,320,595 A * 6/1943 Henkel et al. ..... 297/188.08
3,636,944 A * 1/1972 Bryant ..... 601/16
4,384,857 A * 5/1983 Hoy, Jr. ..... 441/130
5,088,723 A * 2/1992 Simmons ..... 472/129
5,307,527 A * 5/1994 Schober ..... 4/496
5,333,322 A * 8/1994 Weir ..... 4/496
5,439,405 A * 8/1995 Storey et al. ..... 441/127
5,678,890 A * 10/1997 Tenbroeck ..... 297/271.6
6,036,563 A * 3/2000 Walker ..... 441/130
6,773,319 B1 * 8/2004 Carlini, Jr. ..... 441/130
6,808,434 B1 * 10/2004 Park ..... 441/130

* cited by examiner

*Primary Examiner*—Milton Nelson, Jr.
(74) *Attorney, Agent, or Firm*—Gary K. Price, Esq.

(57) ABSTRACT

A swimming pool furniture having a vented assembly that can be submerged in an upright, stationary position on the bottom surface of the swimming pool allowing the user to access the furniture with his or her body partially submerged in the pool. The assembly includes a frame having a plurality of tubular elements including an upper cross member, front and rear lower cross members. The cross members are disposed between a pair of side members of the frame. The frame further includes water inlets in fluid communication with a cavity of the frame. The rear lower cross member includes a vertical member having a water inlet in fluid communication with the cavity of the frame. The frame can further include a seat that attaches to the upper cross member of the frame. As the furniture is submerged into the swimming pool, the water inlets receive water from the swimming pool into the cavity of the frame until the frame is full of water. The weight of the water within the frame will cause the furniture to rest on the bottom surface of the swimming pool. To remove the furniture from the bottom of the pool, the existing pool's vacuum system is attached to the vertical member. Activation of the pool's vacuum removes water from the cavity of the frame through the vertical member causing the furniture to float to the top of the water level in the pool allowing for easy removal of the now, lightweight furniture.

18 Claims, 4 Drawing Sheets

SWIMMING POOL FURNITURE

CROSS REFERENCES TO RELATED APPLICATIONS

U.S. Provisional Application for Patent No. 60/734,847, filed Nov. 9, 2005, with title "Swimming Pool Furniture" which is hereby incorporated by reference. Applicant claims priority pursuant to 35 U.S.C. Par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates generally to furniture which may be conveniently used with a pre-existing swimming pool, and more particularly the furniture of the present invention discloses a vented assembly that is submerged in an upright, stationary position on the bottom surface of the swimming pool allowing the user to access the furniture with his or her body partially submerged in the pool water.

2. Brief Description of Prior Art.

There are a wide variety of pool accessories available. The availability of a means to permit a swimmer to rest in a comfortable sitting position for example, in a stable seat within a swimming pool has likewise become increasingly desirable. While it is possible to simply lower a chair or stool into the water of a swimming pool, as a seating means, this is awkward and generally uncomfortable and unsatisfactory and, sometimes, even hazardous when the seat becomes dislodged or moves. Various schemes devised to afford seating arrangements within or adjacent to the pool have been proposed. Such prior art includes various means of attaching the seat means to the side wall of the swimming pool. However, many swimmers would prefer not to be limited to sitting directly adjacent the side of the swimming pool. Another option in the prior art includes floating devices which allow an individual to sit in the device and float with his or her body partially submerged. Many swimmers, however, would prefer to sit in a more upright position to that of a conventional chair.

As will be seen from the subsequent description, the preferred embodiments of the present invention overcome the above problems and difficulties of the prior art.

There remains a need for a conveniently adaptable furniture assembly that can be used with existing swimming pools that does not require assembly to the side of the pool, is comfortable, reliable, economical and practical such as that provided by the present invention.

SUMMARY OF THE INVENTION

The present invention is directed to swimming pool furniture having a vented assembly that can be submerged in an upright, stationary position on the bottom surface of the swimming pool allowing the user to access the furniture with his or her body partially submerged in the pool. While the disclosure of the present invention is adaptable to many types of furniture pieces that would be desirable to have in the swimming pool, the description herein is directed to a pool chair that can be selectively submerged on the bottom surface of the swimming pool. The pool chair includes a base or frame having an upper cross member and front and rear lower cross members, the cross members are disposed between and attached to a pair of side members. Each side member includes a top tubular element having a water inlet in fluid communication with the cavity of the frame. The rear lower cross member also includes vertical extending member having a water inlet that is also in fluid communication with the cavity of the frame. As the furniture is submerged into the swimming pool, the water inlets receive water from the swimming pool into the cavity of the frame until the frame is full of water. Also, as the water enters the inlets, air in the cavity escapes through the inlets. The weight of the water within the frame will cause the furniture to rest on the bottom surface of the swimming pool. The frame can further include a seat that attaches to the upper cross member of the frame. To remove the furniture from the bottom of the pool, the existing pool's vacuum system is attached to the frame via vertical extending member of the rear lower cross member. Activation of the pool's vacuum removes water from the cavity of the frame through the extending member causing the furniture to float to the top of the water level in the pool allowing for easy removal of the now, lightweight furniture.

DESCRIPTION OF THE PREFERRED EMBODIMENT

Figure 1:
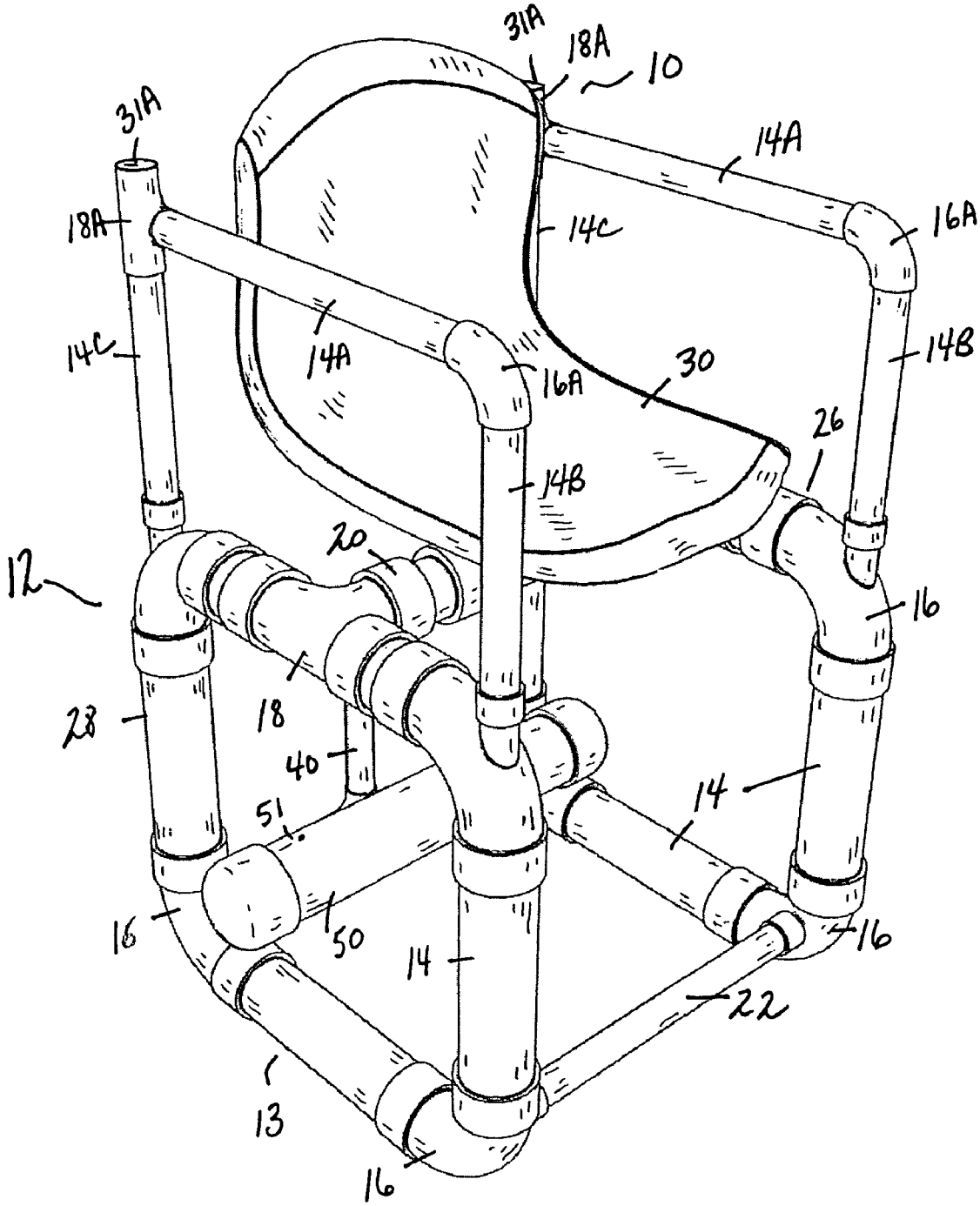
FIG. 1 is a front perspective view of a preferred embodiment of the present invention, a swimming pool furniture.
Figure 2:
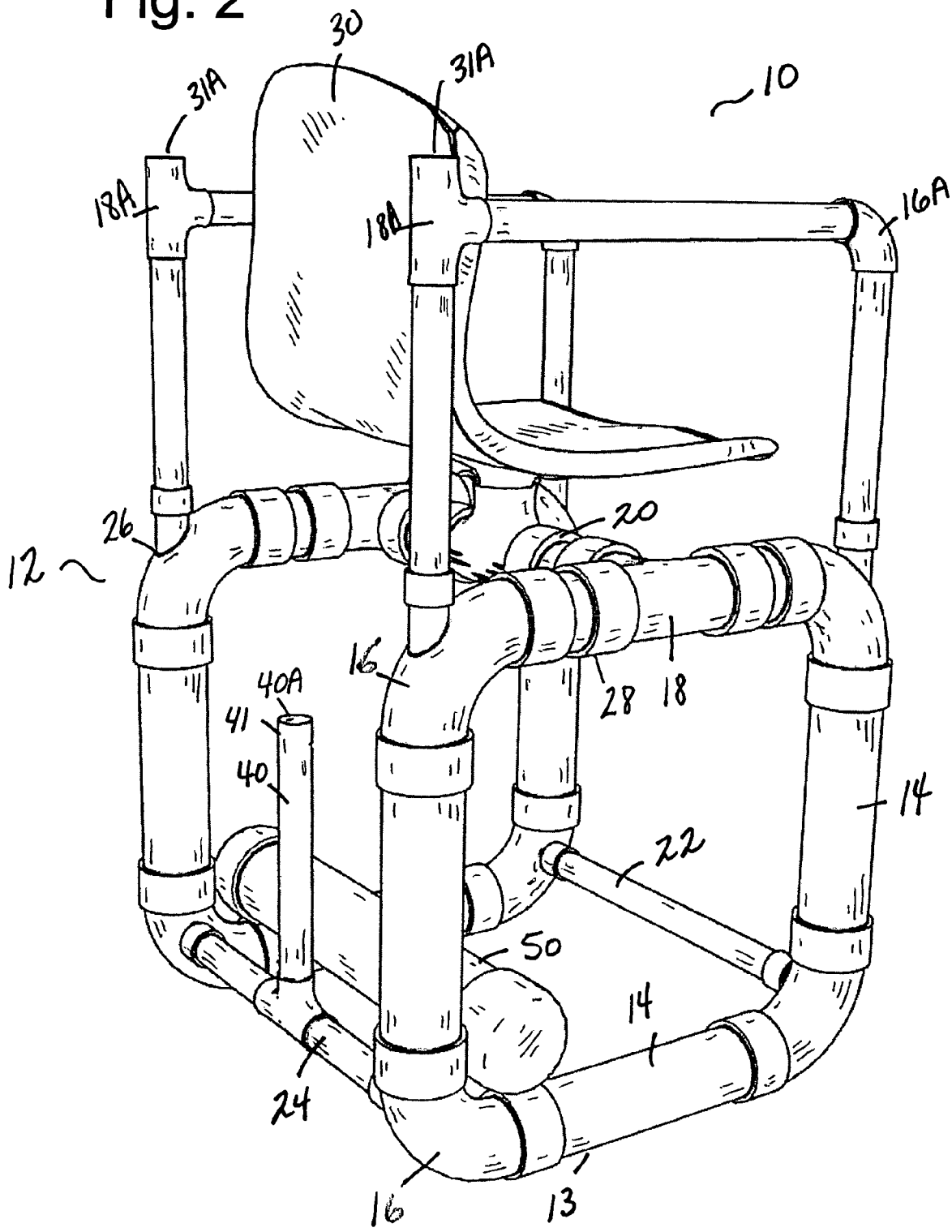
FIG. 2 is a rear perspective view of the swimming pool furniture of FIG. 1.
Figure 3:
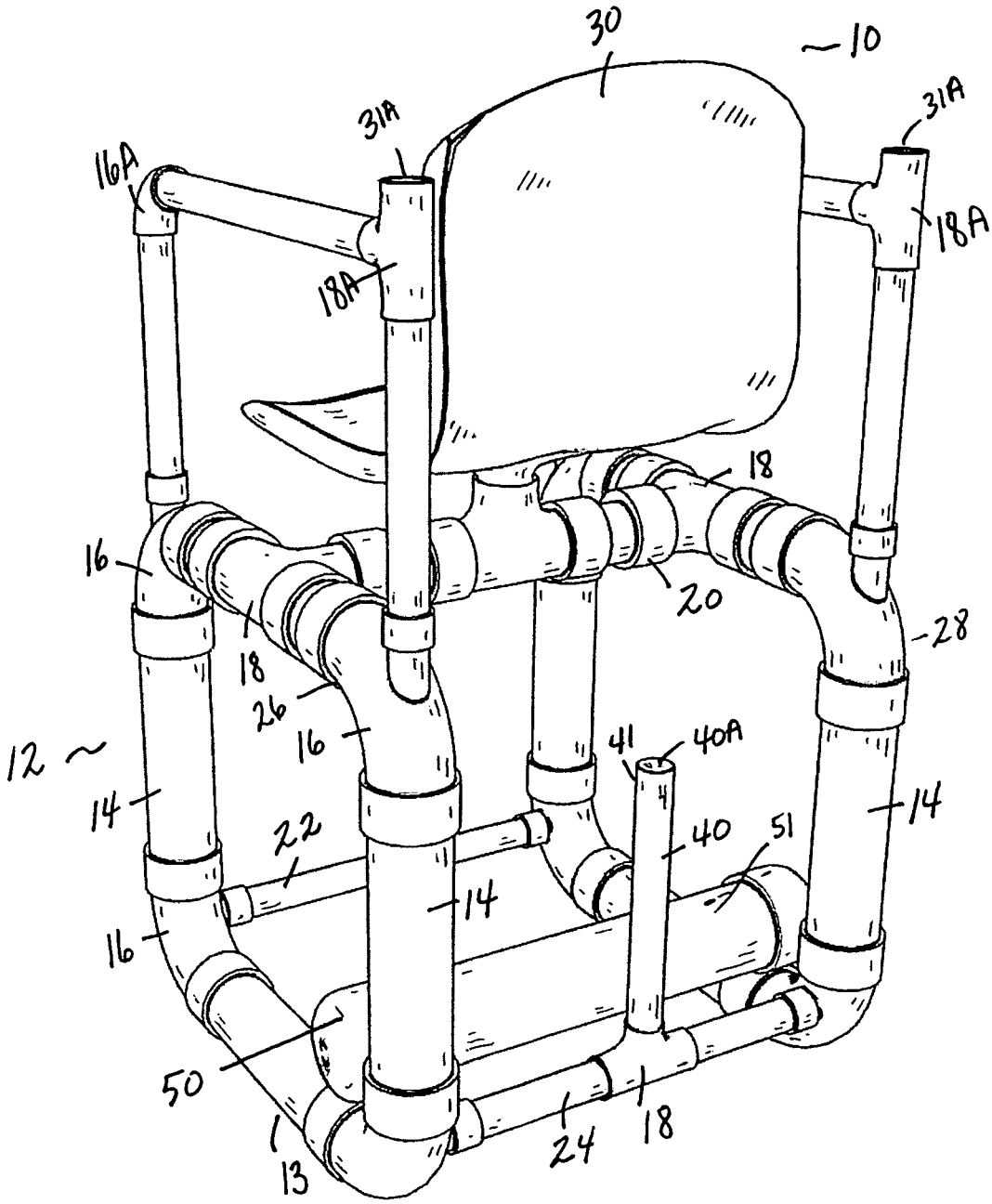
FIG. 3 is a rear view of the swimming pool furniture of FIG. 1.

In accordance with the present invention, a vented swimming pool furniture assembly is disclosed. The swimming pool furniture assembly is directed to an assembly that can be submerged in an upright, stationary position on the bottom surface of the swimming pool allowing the user to access the furniture with his or her body partially submerged in the pool. Specifically, it will be noted in the drawings that the swimming pool furniture assembly relates to an assembly that can be used with existing swimming pools that does not require assembly to the side of the pool, is comfortable, reliable, economical and practical. In the broadest context, the swimming pool furniture of the present invention consists of components configured and correlated with respect to each other so as to attain the desired objective.

As will be seen, the embodiments of the present invention is adaptable to many types of furniture pieces that would be desirable to have in the swimming pool, including, but not limited to a table, a chair or a stool, to name a few. The description and drawings herein will be directed to a pool chair 10 having all the embodiments of the present invention. The pool chair 10 can be selectively submerged on the bottom surface of the swimming pool (not shown) allowing the swimmer to sit on the furniture 10 with his or her body partially submerged in the pool water.

FIG. 1 illustrates a preferred embodiment of the pool chair 10 made in accordance of the present invention. The pool chair 10 generally includes a base or frame 12 formed of a plurality of tubular elements 14 connected together by elbows 16 and T-joints 18. The tubular elements 14, elbows 16, and T-joints 18 preferably are made of PVC.

The frame 12 includes at least one upper cross member 20 and front and rear lower cross members 22, 24 respectively and side members 26, 28. As shown in FIG. 1, each side member 26 and 28 has at least one top tubular element 14A, a front tubular element 14B connected together by an elbow 16A to form substantially a right angle, and a rear tubular element 14C connected to the top tubular element 14A by upper T-joints 18A. As illustrated, the cross members 20, 22, 24 are connected between the side members 26 and 28.

Figure 4:
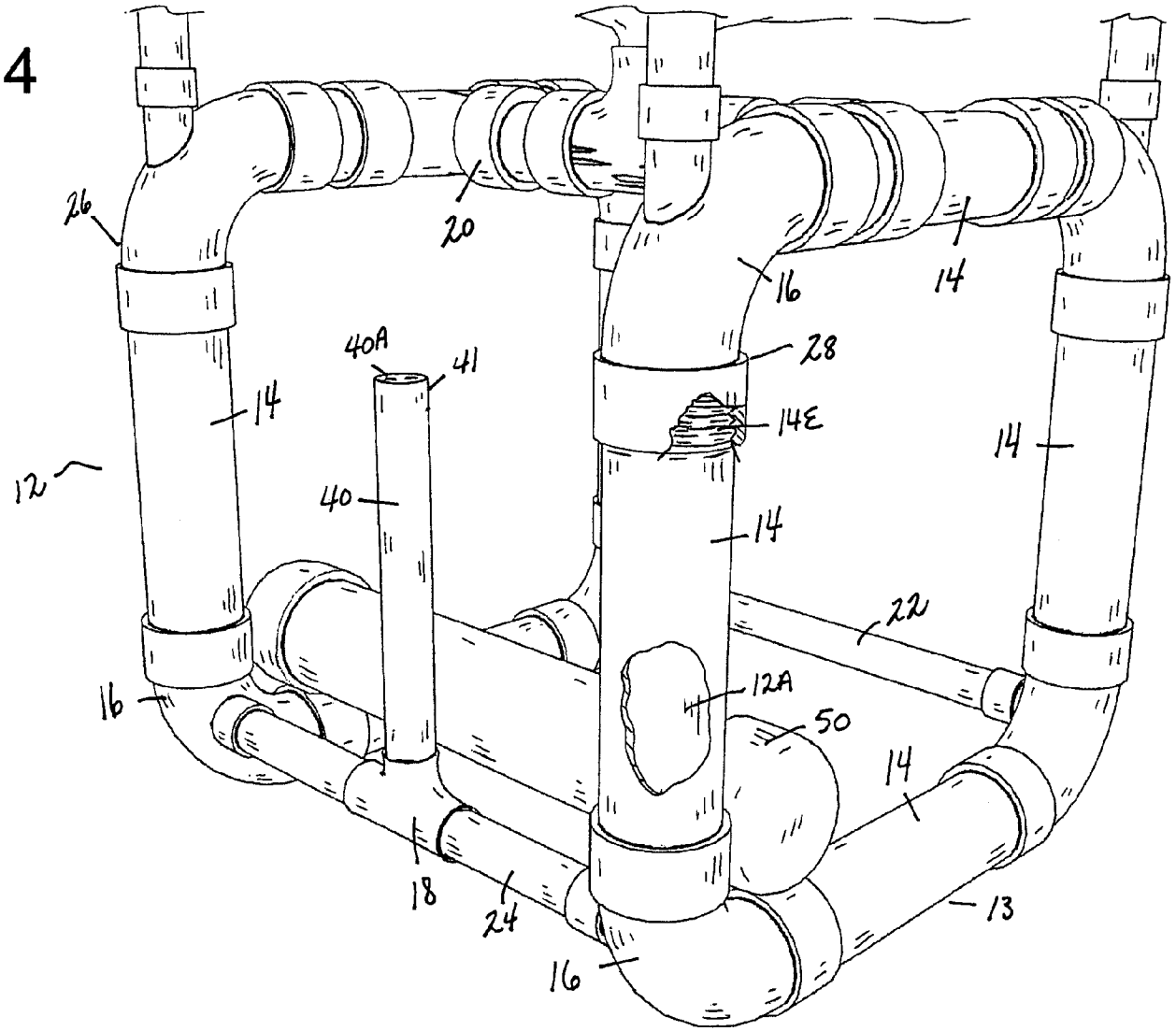
FIG. 4 is a partial sectional view of the base section of the swimming pool furniture of FIG. 1.

As shown in FIG. 4, the ends of tubular elements 14 are threaded 14E, and internal surfaces 19 of the elbows 16 and T-joints 18 are threaded to allow the frame 12 to be easily assembled or disassembled.

The upper T-joints 18A includes a water inlet 31A in fluid communication with an interior surface or cavity 12A (shown in FIG. 4) of the frame 12 to permit ready receipt of water within the frame 12 when the furniture 10 is submerged.

In application, as the furniture 10 is submerged into the swimming pool, the water inlets 31A receive water from the swimming pool into the cavity 12A of the frame 12 until the frame 12 is full of water. The weight of the water within the cavity 12A of the frame 12 will cause the furniture 12 to rest on the bottom surface of the swimming pool.

As illustrated, the frame 12 can include a seat 30 that attaches to the upper end 13A of the frame 12. While the furniture 10 can include a single seat 30 as shown and described, it should be understood that the frame 12 can be designed to include paired seats to enhance and provide conversation between two bathers. Further, while the illustration and description include a seat attached to the upper surface of the frame 12, it is understood that in a similar manner, the apparatus 10 is adaptable to many types of furniture pieces including, but not limited to a table, the table top is attached to the upper surface, such that or a stool for example.

The rear lower cross member 24 includes a vertically extending member 40 that includes an inlet 40A. The inlet 40A, like the inlets 31A is in fluid communication with the cavity 12A of the frame 12. As will be further described, a top end 41 of the extending member 40, which top end 41 having the inlet 40A, is designed to attach to the swimming pool's vacuum.

As previously discussed, as the furniture 10 is submerged into the swimming pool, the water inlets 31A, 40A receive water from the swimming pool into the cavity 12A of the frame 12 until the frame 12 is full of water. As pool water enters the cavity 12A as discussed, air within the cavity 12A escapes through the inlets 31A, 40A, primarily the water inlets 31A.

To remove the furniture 10 from the bottom of the pool, the existing pool's vacuum system is attached to the top portion 41 of the extending member 40. The pool's vacuum is thus connected to the frame 12 via the extending member 40. Activation of the pool's vacuum removes water from the cavity 12A of the frame 12 through the inlet 40A into the pools filtration system. Removing the water from the cavity 12A of the frame 12 causes the furniture 10 to float to the top of the water level in the pool allowing for easy removal of the now, lightweight furniture.

The frame 12 can further include at least one weight 50 that is disposed between and attached to the side members 26, 28, preferably in parallel relation with cross members 20, 22, 24. It is critical that the weight 50 is not in fluid communication with the cavity 12A of the frame 12. The weight 50 includes an inlet 51 to access a chamber (not shown) within the weight 50. In application, the chamber is filled with sand or water in order to further anchor the frame 12, although the inventor has found that the weight of the frame 12, when the cavity 12A is full of water as previously discussed, is sufficient to maintain the furniture 10 stable on the bottom floor of the swimming pool.

The frame 12 further includes a surface-end 13. In application, the surface-end 13 rests on the floor or bottom of the swimming pool. The surface-end 13 of the frame 12 can be skimmed or trimmed by cutting means known in the art in order to conform the surface-end 13 to the curve or taper of the pool bottom, i.e., modified from a horizontal bottom, to follow the contour of the swimming pool bottom surface.

As should be understood, the furniture 10 is immersed in the pool water at the shallow end of the pool so that the water level, when an adult person is seated on the seat 30 of the frame unit 12, reaches to about the lower chest of the seat occupant.

The pool furniture 12 is constructed so as to facilitate its placement at the shallow end of a swimming pool with minimum effort. Further, the pool furniture 10 of the present invention requires no modification of the swimming pool wall, floor or other part of the swimming pool construction.

Although the description above contains many specificities, these should not be construed as limiting the scope of the invention but as merely providing illustrations of some of the presently preferred embodiments of this invention. For example, and as previously discussed, while the furniture 10 is described as being a pool chair, other types of furniture can be designed utilizing the venting assembly described. As such, it is to be understood that the present invention is not limited to the embodiments described above, but encompasses any and all embodiments within the scope of the claims.

It will be obvious to those skilled in the art that modifications may be made to the embodiments described above without departing from the scope of the invention. Thus the scope of the invention should be determined by the claims in the formal application and their legal equivalents, rather than by the examples given.

I claim:

1. A base adapted for pool furniture to be submerged in water in a swimming pool, said base comprising a plurality of tubular elements connected together to form a substantially rectangular configuration, said plurality of tubular elements including at least one upper cross member, a lower rear cross member, a lower front cross member and opposing side members, at least one vertical element that vertically extends from said base, said vertical element includes a first water inlet in fluid communication with a cavity of said base such that submerging the at least one vertical element in water in a swimming pool permits said water to fill the cavity of said base, a vertical member that vertically extends from said lower rear cross member, said vertical member includes a second water inlet disposed at a top end of said vertical member, said second water inlet in fluid communication with said cavity, said top end sized to releasably attach to the swimming pool's vacuum system.

2. The base as recited in claim 1, further including a weight disposed between said side members.

3. The base as recited in claim 2, wherein said weight includes an inlet to access a chamber within said weight.

4. The base as recited in claim 3, wherein said chamber is filled with water.

5. The base as recited in claim 1, wherein said plurality of tubular elements are made of PVC material.

6. The base as recited in claim 1, further including an upper end and a surface end opposite said upper end.

7. The base as recited in claim 6, wherein said surface end is adapted to rest on the swimming pool floor.

8. The base as recited in claim 7, further including at least one seat attached to said upper end and disposed between said side members.

9. A pool furniture adapted to be submerged in water in a swimming pool, said pool furniture comprising:

a base made of a plurality of tubular elements connected together to form a substantially rectangular configuration, a lower rear cross member disposed between a pair of opposing side members of said base, at least one hollow member that vertically extends from said base, said at least one hollow member includes a first water inlet in fluid communication with a cavity of said base, a second hollow member that vertically extends from said lower rear cross member, said second hollow member includes a second water inlet disposed at a top end of said second hollow member, said second water inlet in fluid communication with said cavity, said top end sized to releasably attach to a vacuum system of a swimming pool, wherein said second hollow member is in substantial parallel relationship with said at least one hollow member, and at least one seat attached to an upper end of said base, said at least one seat disposed between said side members.

10. The pool furniture as recited in claim 9, further including a surface end opposite said upper end, wherein said surface end is adapted to rest on a swimming pool floor.

11. The pool furniture as recited in claim 9, further including a weight disposed between said side members.

12. The pool furniture as recited in claim 11, wherein said weight includes an inlet to access a chamber within said weight.

13. The pool furniture as recited in claim 12, wherein said chamber is filled with water.

14. A pool furniture adapted to be submerged in water in a swimming pool, said pool furniture comprising:

a base made of a plurality of tubular elements connected together to form a substantially rectangular configuration, said base including a cavity, an upper cross member, a lower front cross member, and a lower rear cross member disposed between a pair of opposing side members of said base, at least one vertical member that vertically extends from said base, said at least one vertical member includes at least one water inlet in fluid communication with said cavity, said at least one water inlet sized to releasably attach to a vacuum system of a swimming pool, and at least one seat attached to an upper end of said base.

15. The pool furniture as recited in claim 14, wherein said base includes an upper end and a surface end opposite said upper end, wherein said surface end is adapted to rest on a swimming pool floor.

16. The pool furniture as recited in claim 15, further including a weight disposed between said side members.

17. The pool furniture as recited in claim 16, wherein said weight includes an inlet to access a chamber within said weight.

18. The pool furniture as recited in claim 17, wherein said chamber is filled with water.

* * * * *